US010830095B2

(12) United States Patent
Akturk et al.

(10) Patent No.: US 10,830,095 B2
(45) Date of Patent: Nov. 10, 2020

(54) IMPINGEMENT COOLING FEATURES FOR GAS TURBINES

(71) Applicant: Siemens Aktiengesellschaft, Munich (DE)

(72) Inventors: Ali Akturk, Oviedo, FL (US); Jose L. Rodriguez, Lake Mary, FL (US); Marco Claudio Pio Brunelli, Orlando, FL (US)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 122 days.

(21) Appl. No.: 16/320,133

(22) PCT Filed: Aug. 30, 2016

(86) PCT No.: PCT/US2016/049349
§ 371 (c)(1),
(2) Date: Jan. 24, 2019

(87) PCT Pub. No.: WO2018/044266
PCT Pub. Date: Mar. 8, 2018

(65) Prior Publication Data

US 2019/0249566 A1 Aug. 15, 2019

(51) Int. Cl.

| | |
|---|---|
| ***F01N 5/02*** | (2006.01) |
| ***F01D 25/12*** | (2006.01) |
| ***F23R 3/00*** | (2006.01) |

(52) U.S. Cl.
CPC ..... *F01D 25/12* (2013.01); *F23R 3/002* (2013.01); *F05D 2250/183* (2013.01);
(Continued)

(58) Field of Classification Search
CPC . F01D 25/12; F01D 5/18; F01D 5/187; F23R 3/002; F23R 2900/03044;
(Continued)

(56) References Cited

U.S. PATENT DOCUMENTS

2016/0238249 A1* 8/2016 Cunha ..... F23R 3/005

FOREIGN PATENT DOCUMENTS

| | | |
|---|---|---|
| EP | 2469034 A2 | 6/2012 |
| WO | 2015057272 A1 | 4/2015 |

(Continued)

OTHER PUBLICATIONS

PCT International Search Report and Written Opinion dated May 3, 2017 corresponding to PCT Application No. PCT/US2016/049349 filed Aug. 30, 2016.

*Primary Examiner* — Len Tran
*Assistant Examiner* — Kamran Tavakoldavani

(57) ABSTRACT

An impingement cooling system for a gas turbine engine includes an initial impingement surface (10) with a centrally located opening (12). A plurality of channels (14) and plurality of sub-channels (22) extends radially outward from the opening (12) and are formed by a plurality of fixtures (16) and plurality of sub-fixtures (24) that each separates each adjacent channel (14) and sub-channel (22) respectively. The plurality of fixtures (16) and plurality of sub-fixtures (24) each have a rounded upstream end (18) in a plane parallel relative to the initial impingement surface (10). The plurality of fixtures (16) and the plurality of sub-fixtures (24) each have a concave shape along a middle portion (54, 56) of the fixture (16) and sub-fixture (24) along an axis perpendicular to the initial impingement surface (10). The plurality of channels (14) is divided into the plurality of sub-channels (22) extending radially outward of an inlet of each channel (14) from a stagnation point (34)
(Continued)

created in the channel at an upstream end (26) of the sub-fixture (24).

5 Claims, 8 Drawing Sheets

(52) U.S. Cl.
CPC .. *F05D 2250/241* (2013.01); *F05D 2250/712* (2013.01); *F05D 2260/201* (2013.01); *F05D 2260/205* (2013.01); *F05D 2260/22141* (2013.01); *F23R 2900/03044* (2013.01)

(58) Field of Classification Search
CPC ..... F05D 2250/183; F05D 2250/241; F05D 2250/712; F05D 2260/201; F05D 2260/205; F05D 2260/22141; F05D 2220/32
See application file for complete search history.

(56) References Cited

FOREIGN PATENT DOCUMENTS

| | | | |
|---|---|---|---|
| WO | 2016007145 | A1 | 1/2016 |
| WO | 2016099662 | A2 | 6/2016 |

* cited by examiner

IMPINGEMENT COOLING FEATURES FOR GAS TURBINES

BACKGROUND

1. Field

The present invention relates to turbine engines, and more specifically to impingement cooling features for a gas turbine.

2. Description of the Related Art

In an industrial gas turbine engine, hot compressed gas is produced. The hot gas flow is passed through a turbine and expands to produce mechanical work used to drive an electric generator for power production. The turbine generally includes multiple stages of stator vanes and rotor blades to convert the energy from the hot gas flow into mechanical energy that drives the rotor shaft of the engine. Turbine inlet temperature is limited by the material properties and cooling capabilities of the turbine parts.

A combustion system receives air from a compressor and raises it to a high energy level by mixing in fuel and burning the mixture, after which products of the combustor are expanded through the turbine.

Gas turbines are becoming larger, more efficient, and more robust. Large blades and vanes are being produced, especially in the hot section of the engine system. These hot sections, or hot path sections, have components exposed to hot turbine flow and experience high temperatures. One common approach to cooling parts in the hot section of a gas turbine is to use impingement jets of colder air onto the hot part. The target surface upon which the jet impinges is flat and is on the cold side of the part as shown in FIGS. 1 and 2. Currently, cooling jet mass flow rate is increased, but this does not lead to efficiency increases.

As gas turbine efficiency is increased, one can increase the firing temperature which in turn increases the metal temperature of the hot section parts or reduce the cooling flow, which also leads to increase in hot section metal temperatures.

SUMMARY

In one aspect of the present invention, an impingement cooling system for a gas turbine engine comprises: an initial impingement surface with a centrally located opening; a plurality of channels extending radially outward from the opening and formed by a plurality of fixtures that each separates each adjacent channel; wherein the plurality of fixtures each have a rounded upstream end in a plane parallel relative to the initial impingement surface located along an edge of the centrally located opening and a rounded downstream end in the plane parallel relative to the initial impingement surface located along an edge of the initial impingement surface; wherein the plurality of fixtures each have a middle portion between a base portion connected to the initial impingement surface and a top portion on an opposite side; wherein the plurality of fixtures each have a concave shape along the middle portion of the fixture along a plane perpendicular to the initial impingement surface; wherein the plurality of channels are divided into a plurality of sub-channels extending radially outward of an inlet of each channel from a stagnation point created in the channel at an upstream end of a sub-fixture; wherein each of the plurality of sub-fixtures have a rounded upstream end and a generally flat downstream end located along the edge of the initial impingement surface; wherein the plurality of sub-fixtures each have a middle portion between a base portion connected to the initial impingement surface and a top portion on an opposite side; wherein each of the plurality of sub-fixtures each have a concave shape along a middle portion of the sub-fixture along a plane perpendicular to the initial impingement surface.

An advantage of the impingement cooling features includes the shape of the channels and sub-channels to guide the flow towards multiple stagnation points to increase the heat transfer, while keeping the flow within the channels and sub-channels.

Another advantage includes having a plurality of spherical shaped fixtures along the initial impingement surface along the sub-channels, further increasing the turbulence and cooling efficiency of the system.

These and other features, aspects and advantages of the present invention will become better understood with reference to the following drawings, description and claims.

BRIEF DESCRIPTION OF THE DRAWINGS

The invention is shown in more detail by help of figures. The figures show preferred configurations and do not limit the scope of the invention.

DETAILED DESCRIPTION

In the following detailed description of the preferred embodiment, reference is made to the accompanying drawings that form a part hereof, and in which is shown by way of illustration, and not by way of limitation, a specific embodiment in which the invention may be practiced. It is to be understood that other embodiments may be utilized and that changes may be made without departing from the spirit and scope of the present invention.

Broadly, an embodiment of the present invention provides an impingement cooling system for a gas turbine engine includes an initial impingement surface with a centrally located opening. A plurality of channels and plurality of sub-channels extends radially outward from the opening and are formed by a plurality of fixtures and plurality of sub-fixtures that each separates each adjacent channel and sub-channel respectively. The plurality of fixtures and plurality of sub-fixtures each have a rounded upstream end in a plane parallel relative to the initial impingement surface. The plurality of fixtures and the plurality of sub-fixtures each have a concave shape along a middle portion of the fixture and sub-fixture along an axis perpendicular to the initial impingement surface. The plurality of channels is divided into the plurality of sub-channels extending radially outward of an inlet of each channel from a stagnation point created in the channel at an upstream end of a sub-fixture.

A gas turbine engine may comprise a compressor section, a combustor and a turbine section. The compressor section compresses ambient air. The combustor combines the compressed air with a fuel and ignites the mixture creating combustion products comprising hot gases that form a working fluid. The working fluid travels to the turbine section. Within the turbine section are circumferential alternating rows of vanes and blades, the blades being coupled to a rotor. Each pair of rows of vanes and blades forms a stage in the turbine section. The turbine section comprises a fixed turbine casing, which houses the vanes, blades and rotor.

Increasing the ability of the flow to cool a part without increasing mass flow is desirable. Embodiments of the present invention provide impingement cooling features for gas turbine components that may allow for a reduction in losses. Ring segments, blades, vanes, platforms, and other components of a turbine engine may have surfaces that may be cooled through the following impingement cooling system.

Figure 1:
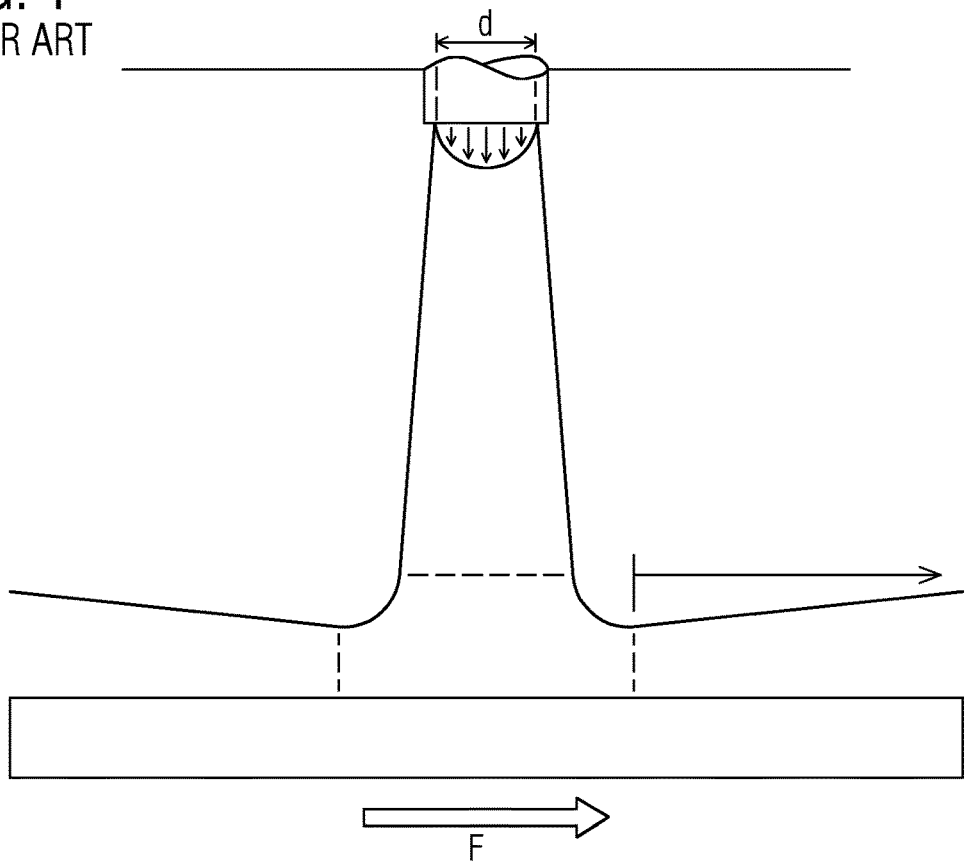
FIG. 1 PRIOR ART
FIG. 1 is a side view of a cooling jet and impingement surface of the prior art.
Figure 2:
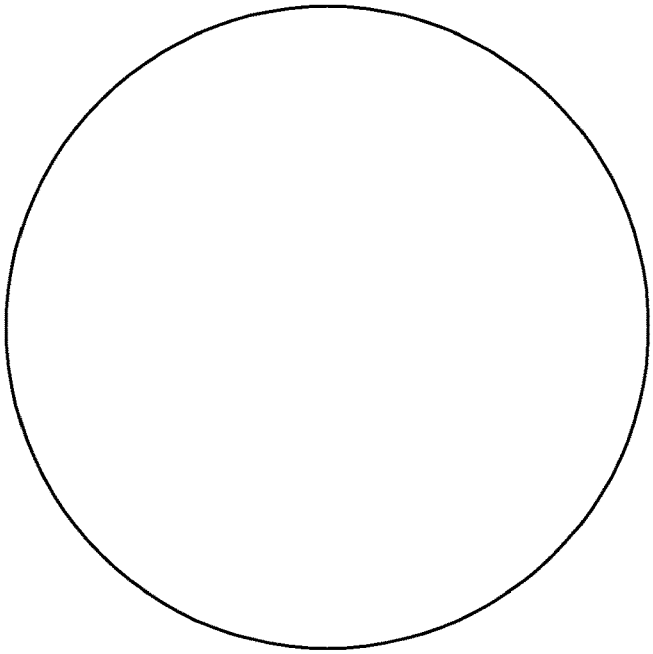
FIG. 2 PRIOR ART
FIG. 2 is a top view of the impingement surface of FIG. 1.
Figure 3:
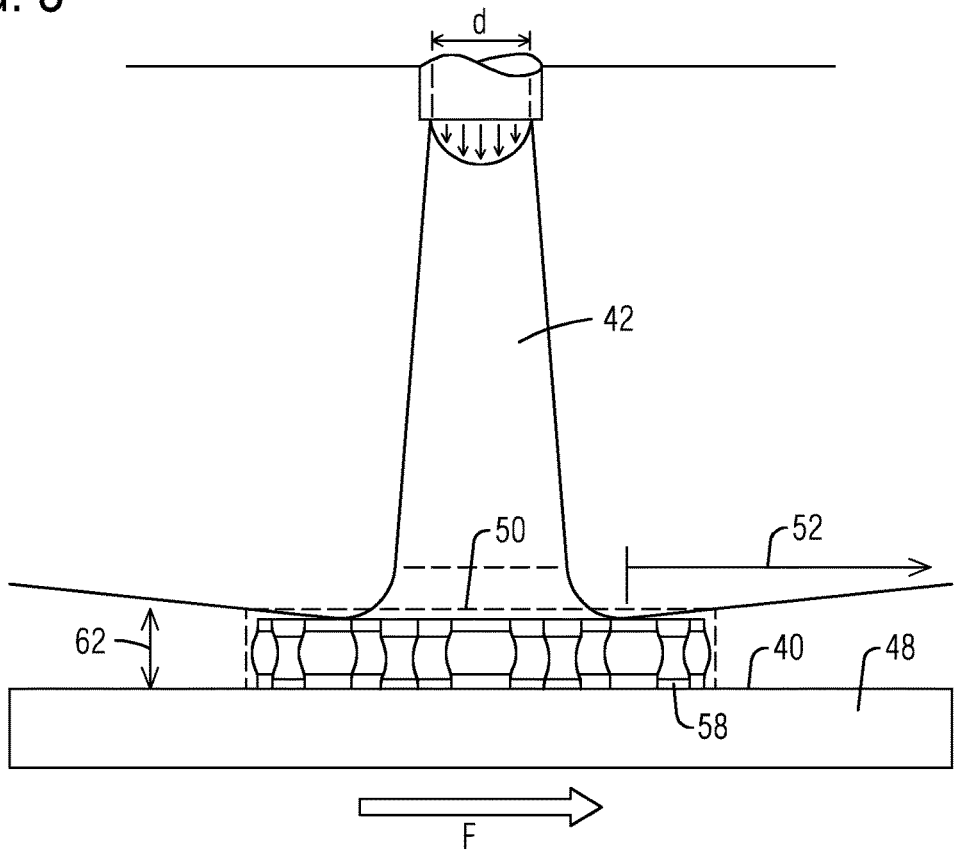
FIG. 3 is a side view of an exemplary embodiment of the present invention.

Referring now to FIG. 3, a portion of a turbine section of a gas turbine engine is shown. A component 48 is shown along a path of hot turbine flow F. The component 48 sees the hot turbine flow F and raises the temperature of the component 48. A cooling jet 42 is directed towards a surface 40 on the opposite side of the hot turbine flow. This surface requires cooling. The cooling jet 42 has a diameter d as shown. A stagnation zone 50 is centrally located on a contoured impingement surface of the component. The cooling jet discharge then turns approximately 90 degrees along a wall jet zone 52.

Figure 4:
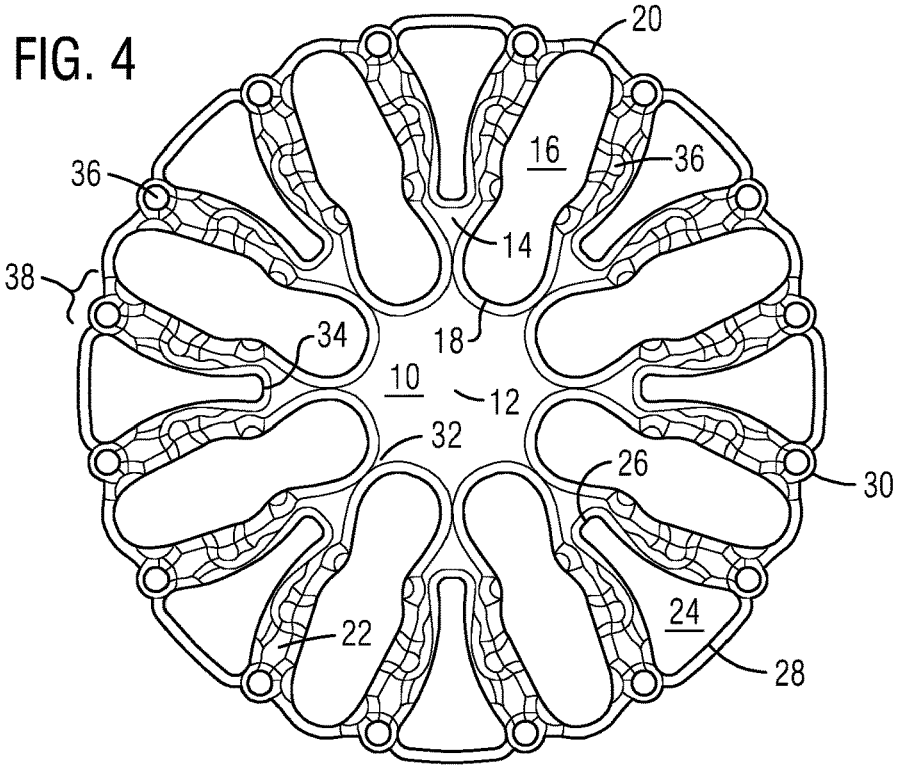
FIG. 4 is a top view of the impingement surface of FIG. 3.
Figure 5:
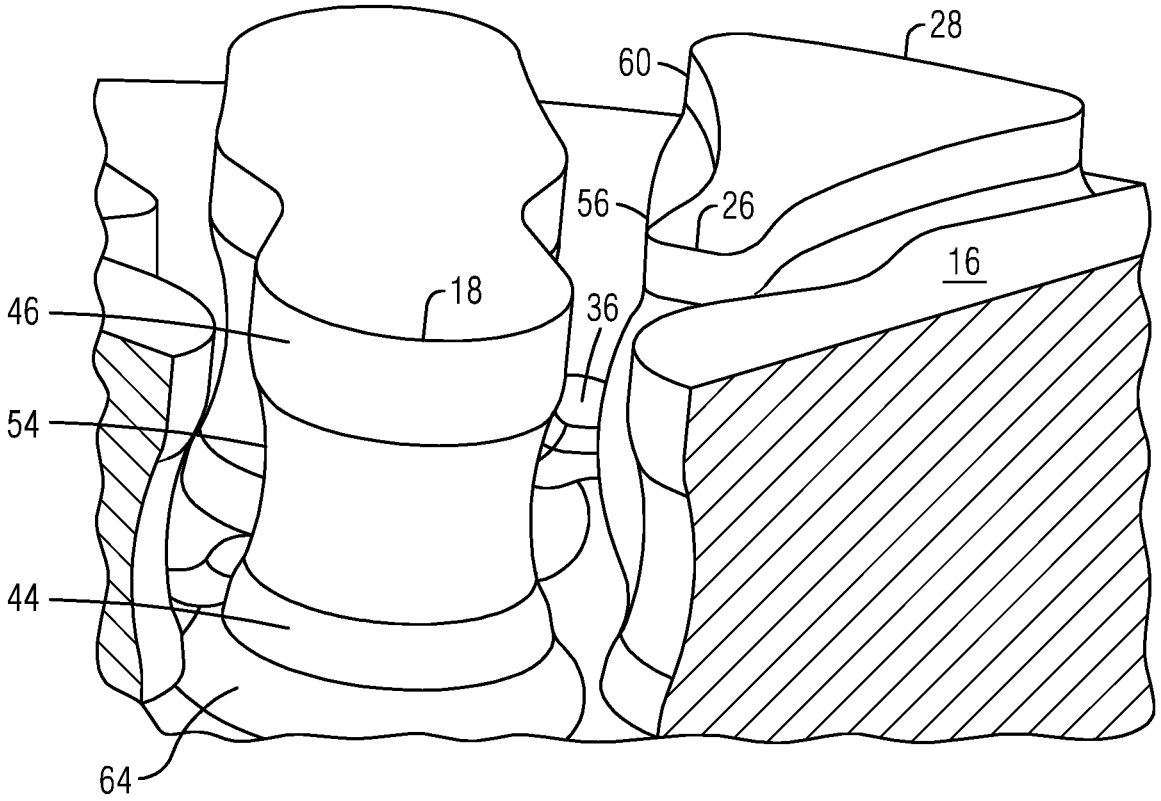
FIG. 5 is a detailed perspective view of cooling channels of an exemplary embodiment.
Figure 6:
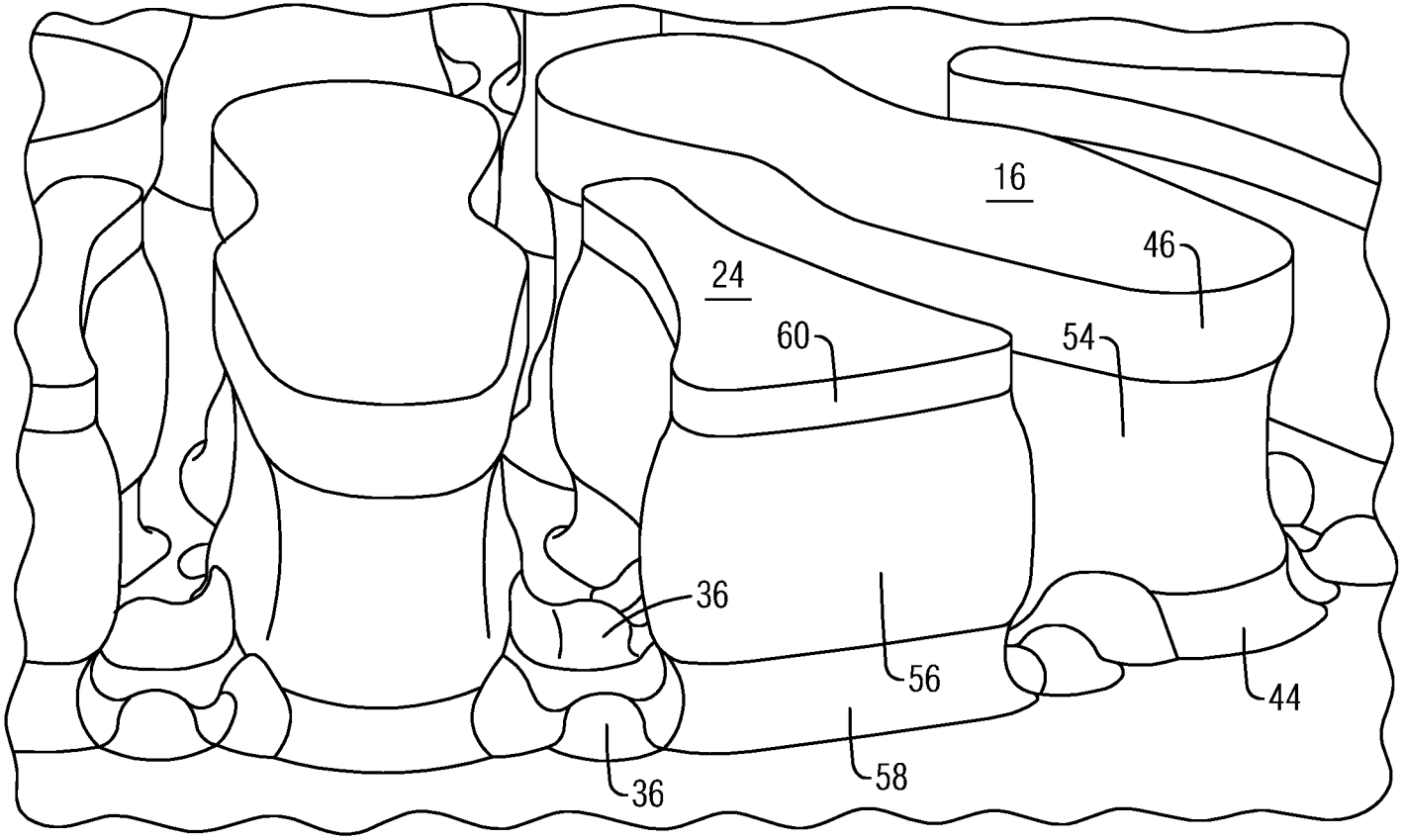
FIG. 6 is another detailed perspective view of cooling channels of an exemplary embodiment.
Figure 7:
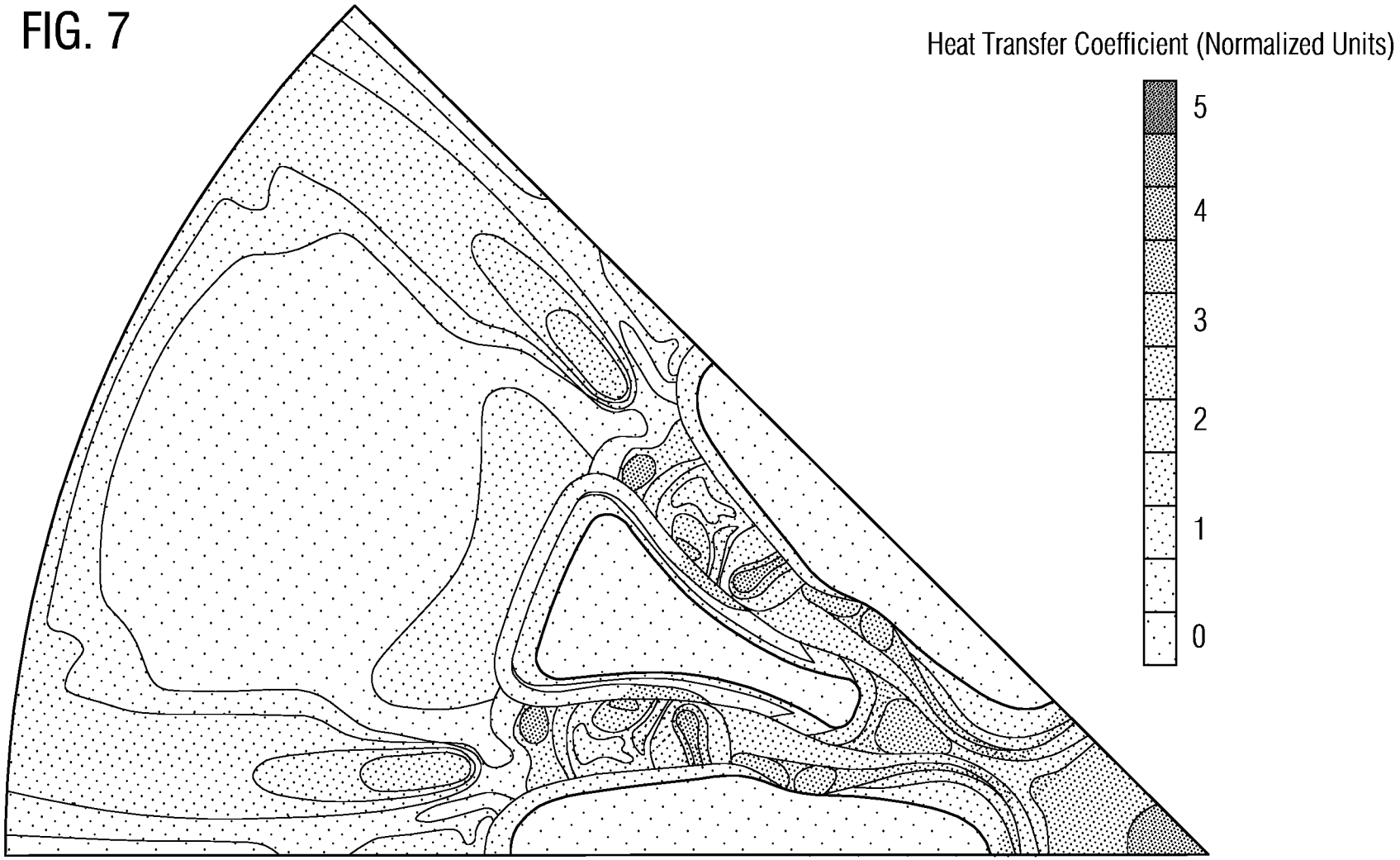
FIGS. 7-10 illustrate flow velocity streamlines and heat transfer distribution through cooling channels of an exemplary embodiment of the present invention.
Figure 8:
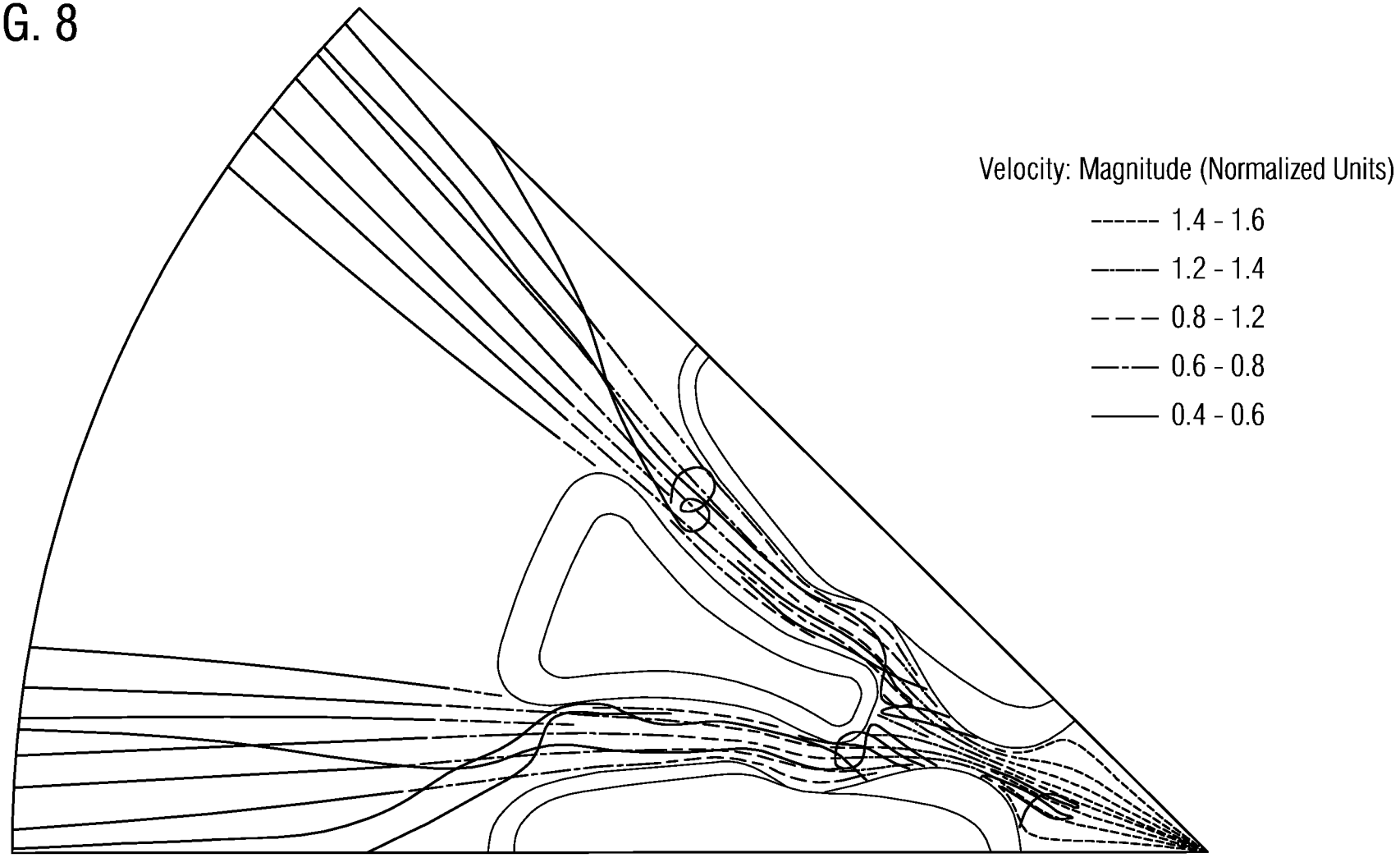
Figure 9:
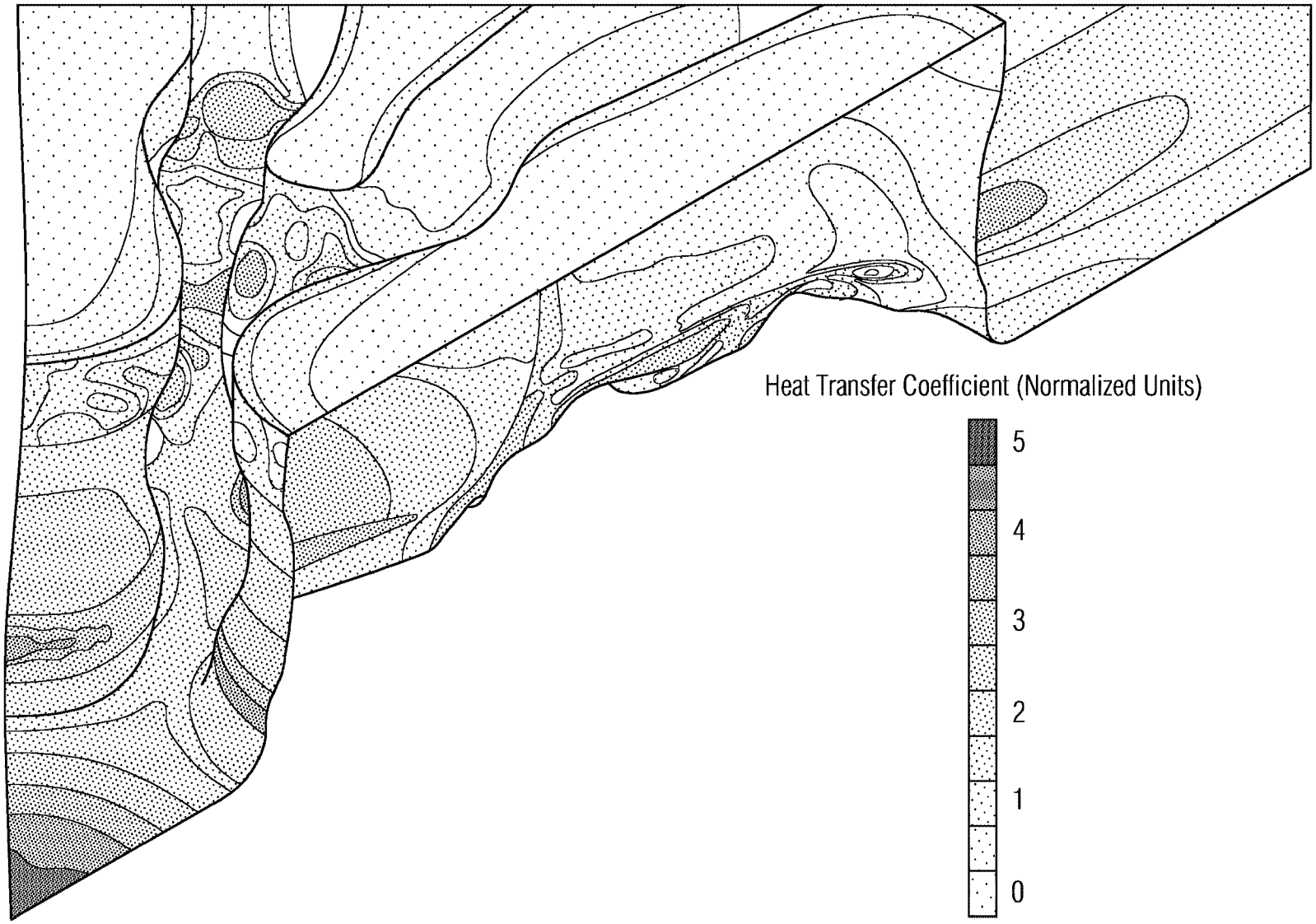
Figure 10:
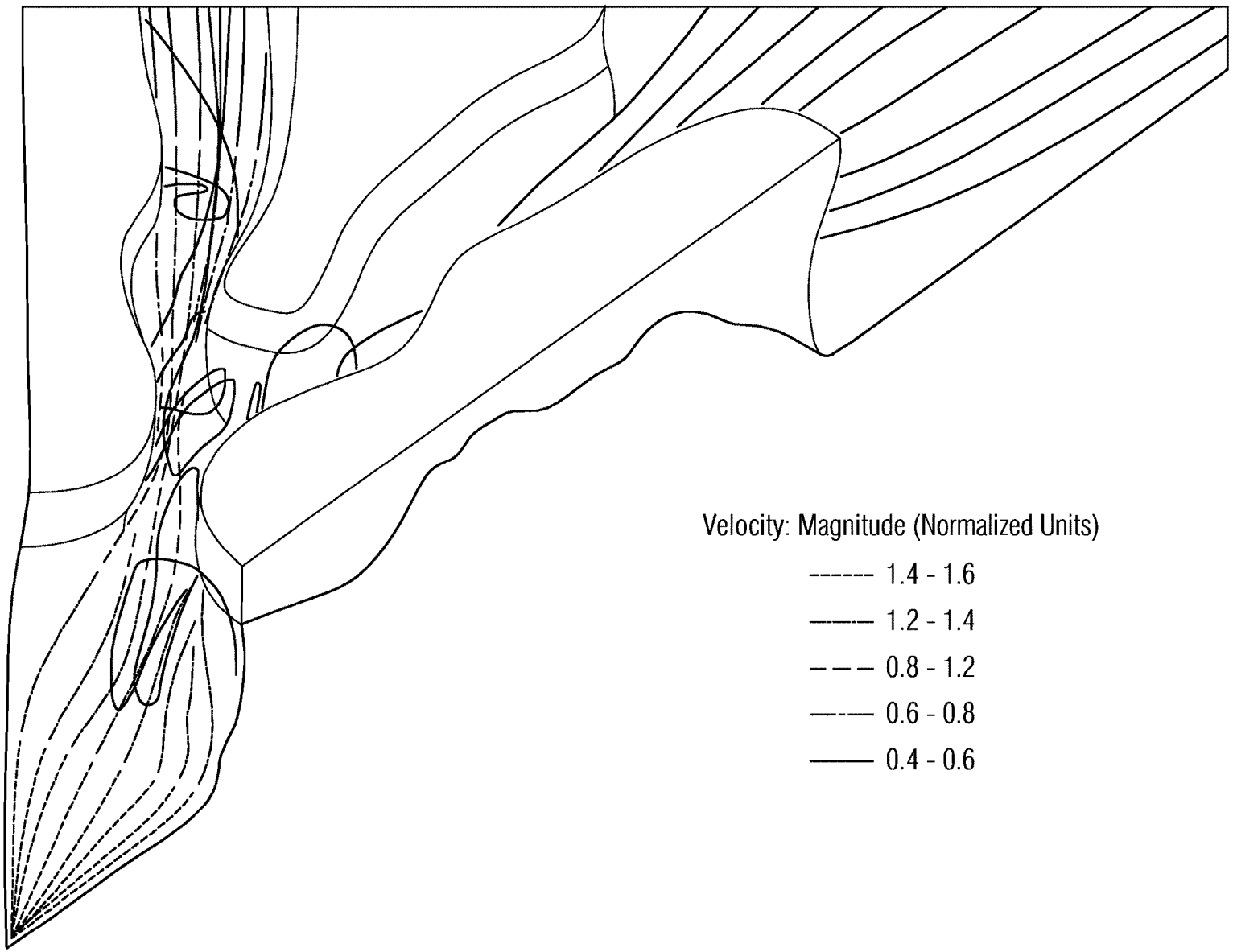

The details of an exemplary embodiment of the impingement cooling system and contoured impingement surface are shown in FIG. 4 from a top view, i.e. from the direction of the cooling jet 42. The details are shown from a side view in FIGS. 5 and 6. The impingement cooling system may include an initial impingement surface 10. The initial impingement surface 10 has a centrally located opening 12. The centrally located opening 12 has an imaginary edge 32 that may run along a circular path around the center of the centrally located opening 12. Along the edge 32 of the centrally located opening 12 may be a plurality of channels 14. The plurality of channels 14 may extend radially outward from the opening 12 and may be formed by a plurality of fixtures 16 that each separates each adjacent channel 14. Each of the plurality of fixtures 16 includes an upstream end 18 along the edge 32 of the opening 12 and a downstream end 20 located along an edge 30 of the initial impingement surface 10. The downstream end 20 and upstream end 18 of each of the fixtures 16 may be rounded in a plane parallel relative to the initial impingement surface 10 as shown in FIG. 4. Each of the plurality of fixtures 16 may have a concave shape along a middle portion 54 of the fixture 16 along a vertical axis 62, an axis that is perpendicular to the initial impingement surface 10. The middle portion 54 of each fixture 16 is between a base portion 44 and a top portion 46. The base portion 44 is connected to the initial impingement surface 10 and the top portion 46 is on an opposite side. In certain embodiments, the base portion 44 and the top portion 46 of each fixture 16 may flare out providing an upper and lower ledge, or extended portion, to the fixture 16 such as with a fillet 64. The edge 30 of the initial impingement surface 10 may run along edges of the plurality of fillets 64 along the base portions of the plurality of fixtures 16 and plurality of sub-fixtures 24. The edge 30 of the initial impingement surface 10 provides an end to the impingement cooling system. An approximate circle made from points along the edge of each of the filleted 64 ends along the base portion 44 of the plurality of fixtures provides the edge 32 of the centrally located opening 12.

In certain embodiments, the shape of the each fixture 16 may initially curve inward on each side and expand and then narrow again closer to the downstream end 20 along the plane parallel relative to the initial impingement surface 10 as is shown in FIG. 4. The shape of each fixture 16 and each sub-fixture 24 allow for the flow to remain in the plurality of channels 14 and the plurality of sub-channels 22 for as long as possible, cooling the surface 40 of the component 48.

The plurality of channels 14 may then be divided into a plurality of sub-channels 22. The plurality of sub-channels 22 may extend radially outward of an inlet of each channel 14 from a stagnation point 34 created in the channel 14 at an upstream end 26 of a sub-fixture 24. There may be a plurality of sub-fixtures 24. Each sub-fixture 24 includes an upstream end 26 and a downstream end 28. Each sub-fixture upstream end 26 may be rounded. The downstream end 28 of each sub-fixture 24 may be located along the edge 30 of the initial impingement surface 10. Each of the plurality of sub-fixtures 24 may include a concave shape along a middle portion 56 of each sub-fixture 24. The concave shape may be along an axis perpendicular to the initial impingement surface 10. The middle portion 56 of each sub-fixture 24 is between a base portion 58 and a top portion 60. The base portion 58 is connected to the initial impingement surface 10 and the top portion 60 is on an opposite side. In certain embodiments, the base portion 58 and the top portion 60 of each sub-fixture 24 may flare out providing an upper and lower ledge to the sub-fixture 24. In certain embodiments, each sub-fixture 24 may have a roughly triangular shape.

In certain embodiments, a plurality of spherical shaped fixtures 36 may be positioned within each sub-channel 22 along the initial impingement surface 10 and extending into each sub-channel 22. At least one raised spherical shaped fixture 36 may be positioned along the initial impingement surface 10 and extending upward into the radially outer exit section 38 along the edge 30 of the initial impingement surface 10 within each sub-channel 22.

In at least one embodiment, the impingement cooling system may include eight channels 14 and sixteen sub-channels 22 as is shown in FIG. 4, or any other number of channels 14 and sub-channels 22 with eight fixtures 16 and eight sub-fixtures 24.

The opening 12 is the first point of contact for cooling fluid, such as, but not limited to, air, from the cooling jet 42. Once the cooling fluid makes contact with the opening 12 along the initial impingement surface 10, the fluid then makes a roughly 90 degree turn. Cooling flow is then driven through the plurality of channels 14 of the contoured surface after stagnating on the flat centrally located opening 12 portion. The top portion 46 of each fixture 16 and top portion 60 of each sub-fixture 24 assist the cooling flow through the plurality of channels 14 and plurality of sub-channels 22 and help to maintain the flow through the plurality of channels 14 and plurality of sub-channels 22. The plurality of channels 14 may guide flow and provide multiple impingement surfaces cooling the overall surface of the component 48. The cooling fluid flows through the plurality of channels 14 and then hits another stagnation point 34 along each of the sub-fixtures 24. The cooling flow will at least impinge on the upstream end 18 of each fixture 16 and stagnation point 34 of each sub-fixture 24. Further, in certain embodiments, the plurality of spherical shaped fixtures 36 may additionally provide further impingement points within the plurality of sub-channels 22 to further decrease flow rate and improve heat transfer. The plurality of spherical shaped fixtures 36 may be along the initial impingement surface 10 along the sub-channels 22, and may further be along the exit section 38 of each sub-channel 22. The cooling flow eventually exits out the radially outer exit section 38 along the edge 30 of the initial impingement surface 10. The geometry of each channel 14 increases the total surface areas for the cooling to occur. Heat transfer and the heat transfer rate may increase with the addition of the plurality of fixtures 16, the plurality of sub-fixtures 24, and the plurality of spherical shaped fixtures 36.

This effect may be explained referring to FIGS. 7-10, which illustrate flow rate and surface heat transfer coefficient of all flow across the contoured impingement surface according to embodiments of the present invention. As can be seen in the figures, the highest heat transfer occurs in the initial impingement and stagnation point at the centrally located opening 12. The figures show speed and heat transfer changes as the cooling flow crosses through the plurality of channels 14 and plurality of sub-channels 22. The radially outer exit section 38 shows a significant decrease in flow velocity and heat transfer at the radially outer exit versus the initial stagnation point. The figures show that spikes of heat transfer occur at the upstream end 18 of each fixture 16 and upstream end 26 of each sub-fixture 24, as well as contact with the plurality of spherical shaped fixtures 36. The shape of the plurality of fixtures 16 and plurality of sub-fixtures 24, along with the plurality of spherical shaped fixtures 36 in some embodiments, provides a pathway for the cooling fluid to move through along the plurality of channels 14 and plurality of sub-channels 22. The shape provided allows for the flow to be maintained longer throughout the plurality of channels 14 and plurality of sub-channels 22. The top portion 46 along the plurality of fixtures 16 and the concave shape perpendicular from the surface forces the flow back into the plurality of channels 14 to continue hitting multiple impingement surfaces. The channel geometry provides as many impingement surfaces as possible. The channel geometry further increases the total surface area for cooling purposes.

The physical contours and lines of the improved impingement surface cannot be manufactured with conventional casting methods. Technology that combines stack lamination with certain molding processes can be used as a casting process that may allow for the detail required for embodiments of the present invention. Selective Laser Melting (SLM) is another example of a manufacturing method. The flow stays longer within the channels 14 created with the contoured surface in embodiments of the present invention.

While specific embodiments have been described in detail, those with ordinary skill in the art will appreciate that various modifications and alternative to those details could be developed in light of the overall teachings of the disclosure. Accordingly, the particular arrangements disclosed are meant to be illustrative only and not limiting as to the scope of the invention, which is to be given the full breadth of the appended claims, and any and all equivalents thereof.

What is claimed is:

1. An impingement cooling system for a gas turbine engine comprising:

an initial impingement surface with a centrally located opening;

a plurality of channels extending radially outward from the centrally located opening and formed by a plurality of fixtures that each separates each adjacent channel;

wherein each of the plurality of fixtures has a rounded upstream end in a plane parallel relative to the initial impingement surface located along an edge of the centrally located opening and a rounded downstream end in the plane parallel relative to the initial impingement surface located along an edge of the initial impingement surface;

wherein each of the plurality of fixtures has a middle portion between a base portion connected to the initial impingement surface and a top portion on an opposite side;

wherein the middle portion of each of the plurality of fixtures has a concave shape along a plane perpendicular to the initial impingement surface;

wherein the plurality of channels are divided into a plurality of sub-channels, each of the plurality of sub-channels extending radially outward of an inlet of each of the plurality of channels from a stagnation point created in each of the plurality of channels at an upstream end of each of a plurality of sub-fixtures;

wherein each of the plurality of sub-fixtures has a rounded upstream end and a generally flat downstream end located along the edge of the initial impingement surface;

wherein each of the plurality of sub-fixtures has a middle portion between a base portion connected to the initial impingement surface and a top portion on an opposite side;

wherein the middle portion of each of the plurality of sub-fixtures has a concave shape along the plane perpendicular to the initial impingement surface.

2. The impingement cooling system according to claim 1, wherein each of the plurality of sub-channels further comprises a plurality of spherical shaped fixtures positioned along the initial impingement surface and extending into each of the plurality of sub-channels.

3. The impingement cooling system according to claim 1, wherein at least one of the plurality of spherical shaped fixtures extends upward into a radially outer exit section along the edge of the initial impingement surface within each of the plurality of sub-channels.

4. The impingement cooling system according to claim 1, wherein each of the plurality of fixtures initially curves inward and expands and narrows closer to the downstream end along the plane parallel relative to the initial impingement surface.

5. The impingement cooling system according to claim 1, wherein each of the plurality of fixtures is connected to the initial impingement surface by a fillet along the base portion of each of the plurality of fixtures.

* * * * *